US006441707B2

(12) United States Patent
Swartzentruber et al.

(10) Patent No.: US 6,441,707 B2
(45) Date of Patent: Aug. 27, 2002

(54) ELECTRICAL RELAY CONTACTOR

(75) Inventors: Brent James Swartzentruber, Carpinteria; Eric Glenn Hufstedler; James Clayton Reed, both of Santa Barbara; Marcus Priest, Carpinteria; Bernard Victor Bush; Michael Henry Molyneux, both of Santa Barbara, all of CA (US)

(73) Assignee: Kilovac Corporation, Carpinteria, CA (US)

( * ) Notice: Subject to any disclaimer, the term of this patent is extended or adjusted under 35 U.S.C. 154(b) by 51 days.

(21) Appl. No.: 09/766,049

(22) Filed: Jan. 19, 2001

Related U.S. Application Data

(60) Provisional application No. 60/177,136, filed on Jan. 20, 2000.

(51) Int. Cl.[7] ..... H01H 51/22

(52) U.S. Cl. ..... 335/78; 335/132; 335/202

(58) Field of Search ..... 335/78–86, 124, 335/128, 132, 202; 200/293–308

(56) References Cited

U.S. PATENT DOCUMENTS 4,827,231 A * 5/1989 Cheski et al. ..... 335/17
5,111,171 A * 5/1992 Von Bonin et al. ..... 335/202
5,886,602 A * 3/1999 Burel et al. ..... 335/132

* cited by examiner

*Primary Examiner*—Lincoln Donovan
(74) *Attorney, Agent, or Firm*—Christie, Parker & Hale, LLP

(57) ABSTRACT

A electrical conductor relay. The relay has a unitary, non-conducting, chassis/bobbin assembly with a base portion, a bobbin portion, and an upper portion with a window and a plunger slide passage. An electromagnetic coil is located around the bobbin portion and a magnetic metal core passes through the bobbin and extends partially into the window. First and second electrodes are attached to the chassis/bobbin assembly. The first electrode has a first electrode contact, and the second electrode has a top end. A plunger slide member is positioned within the plunger slide passage and has a magnetic metal plunger plate affixed to its bottom. The magnetic metal plunger plate is movably located in the window and is spaced above the magnetic metal core extending up into window. An armature with a fulcrum end and a rearwardly extending spring attachment end and a front end with an armature contact is provided. The armature pivotally engaged with the plunger slide member. The fulcrum end pivotally contacts the top end of the second electrode. A spring attaches to spring attachment end and tends to raise the front end of the armature and the armature contact away from the first electrode contact when the electromagnetic coil is not energized.

18 Claims, 6 Drawing Sheets

ELECTRICAL RELAY CONTACTOR

CROSS REFERENCE TO RELATED APPLICATIONS

The present application claims the benefit of U.S. provisional patent application No. 60/177,136 entitled "ELECTRICAL RELAY CONTACTOR," filed Jan. 20, 2000, the contents of which are hereby incorporated by reference.

BACKGROUND OF THE INVENTION

1. Field of Invention

The invention relates generally to the field of electrical relays, and more particularly to a high voltage electrical relay contactor having a reduced number of and lower cost parts.

2. Description of the Prior Art

Electrical relays are used in a wide variety of applications, including in automotive, aircraft, and industrial applications, and are used for power switching applications. All electrical relays permit a relatively small voltage source to actuate a gate for larger voltage/currents.

Electrical relays, particularly high voltage electrical relays, have tended to be relatively expensive. The relatively high expense relate to deficiencies in the available designs, which include the need for relatively expensive materials, and a comparatively large number of complex parts which must be separately manufactured and assembled.

For example, past electrical relays have included armatures with multiple contact points made of expensive materials, such as silver, in lieu of copper or brass, for example. While increasing the number and/or size of the points of contacts and/or the conductance of the materials used can all improve the electrical flow characteristics through the electrical relay contactor, these solutions all result in greater expense, and do not necessarily add to the mechanical and electrical reliability of these devices.

There accordingly remains a need for a new design for an electrical relay contactor which has fewer parts, that is made of less expensive materials, and that can be more easily and quickly assembled.

SUMMARY OF THE INVENTION

One object of the invention is to provide a new design for a modular electrical relay contactor that is easily and quickly assembled from relatively few parts.

Another object of the invention is to provide a new design for a modular electrical relay contactor that is made from relatively low cost components, and in which modular units can be ganged together to provide for multi-phase switching.

A further object of the invention is to provide a modular electrical relay contactor that is reliable over a wide variety of conditions, and which assures that synchronous switching between the plurality of modules.

These and other objects of the inventions are achieved by providing a new design of modular single pole, double throw electrical relay contactor in which a moveable contactor is carried by a modular receptacle designed with the receptacle of an adjacent electrical relay contactor.

To provide for a lower material and assembly costs, a small number of non-conducting and metallic units can be quickly screwed and/or slipped together. This feature simplifies assembly, reduces costs, and improves the quality.

DETAILED DESCRIPTION OF THE INVENTION

Figure 1:
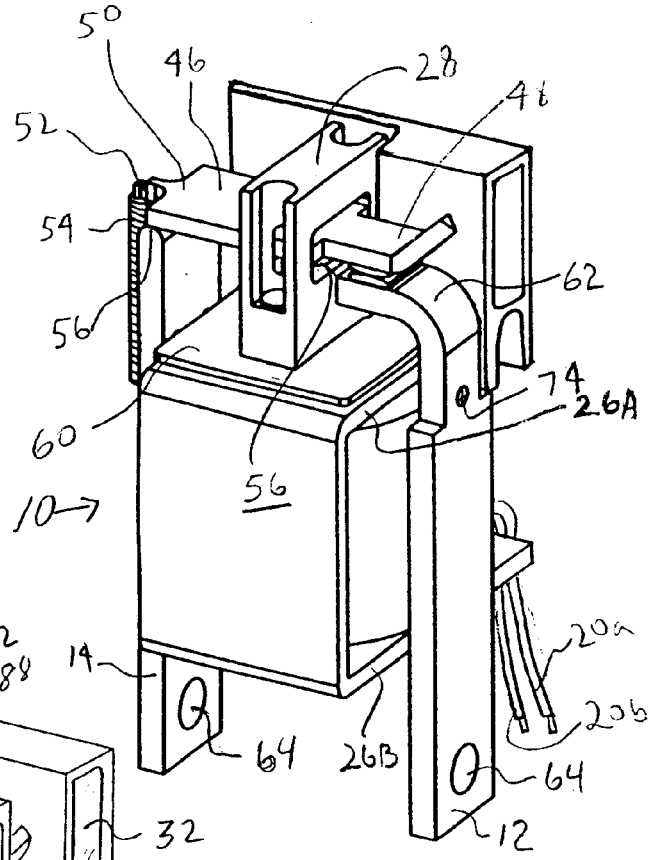
FIG. 1 is a perspective view of three modular electrical relay conductors ganged together into a three-phase relay.

Referring to the FIG. 1, a perspective view of the electrical relay conductor 10 of the invention is shown. Electrical relay contactor 10 has a first electrode 12 and a second electrode 14. First electrode 12 and a second electrode 14 are attached to a combination chassis/bobbin assembly 16, with its magnetic coil 18 formed around the bobbin portion (not shown). Coil lead wires 20*a* and 20*b* are provided for energizing electromagnet coil 18, which can be formed of a long section of wire looped around bobbin. Combination chassis/bobbin assembly 16 includes an upper portion 22 and a base portion 24 (joined by the non-visible bobbin that is surrounded by electromagnetic coil 18.) A metallic C-clamp 26 (such as formed of stainless steel or other magnetic material) engages with upper portion 22 and base portion 24. A plunger slide member 28 is adapted to slidably move up in down within upper part 24 of chassis/bobbin assembly 16. Upper part 22 includes permanent magnet cavities 30 which receives permanent magnets 32.

Figure 5:
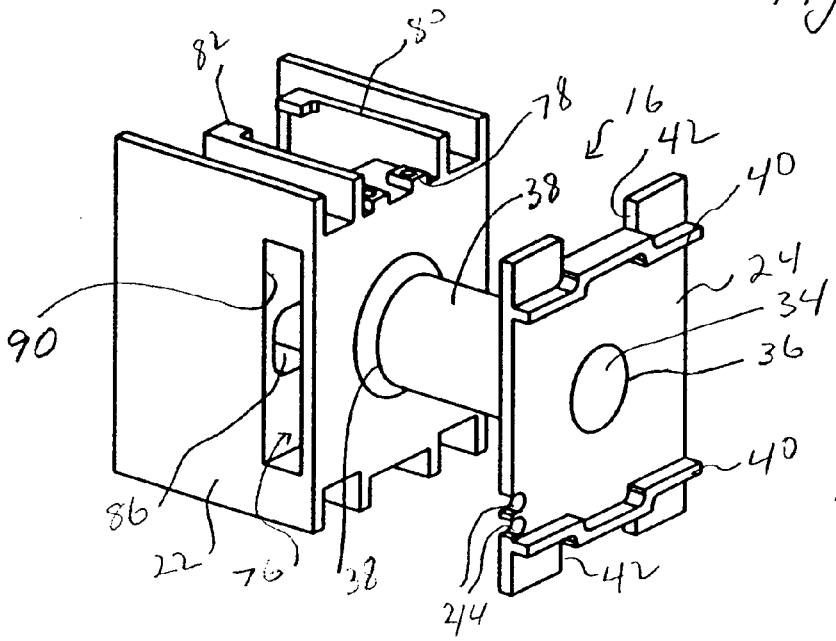
FIG. 5 is a cross-sectional view of a single electrical relay conductor through view lines 5—5 of FIG. 1.

FIG. 5 is a perspective view of combination chassis/bobbin assembly 16, and FIGS. 6–12 are various other view of combination chassis/bobbin assembly 16 showing details thereof, with the electromagnet coil being removed to better show the structure. Referring to FIG. 5, a magnetic metal core 34 passes through a center core passage 36 that is formed through base portion 24 and a bobbin portion 38, and exits into a C-clamp window 76. C-clamp window is generally horizontal. Upper portion 22, lower portion 24, and bobbin 38 are made of non-conducting material, such as nylon reinforced plastic. Other non-conducting materials can equally well be utilized, so long as they are durable.

Upper portion 22, lower portion 24, and bobbin 38 can preferably be formed as a unitary structure to reduce the number of pieces and simplify assembly. C-clamp guides 40 are formed on underside of base portion 24 and assist in securing of the C-clamp. Electrode notches 42 are also formed onto opposed edges of base portion 24, and act to stabilize first and second electrodes (as shown in FIG. 1.) Lead wire notches 44 are formed in base portion 24.

Figure 2:
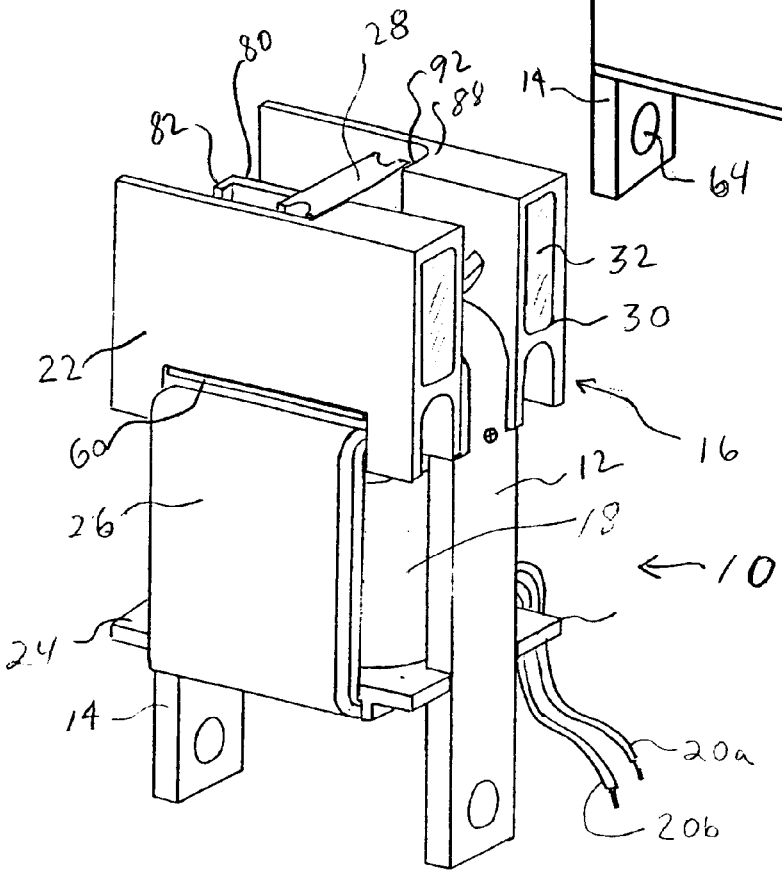
FIG. 2 is side view of the electrical relay conductor of FIG. 1.

Turning now to FIG. 2, a perspective view of electrical relay conductor 10 of FIG. 1 is shown, but with portions of upper portion 22 removed to reveal additional parts. An armature 46 is provided with a front, upturned end 48 and a fulcrum end 50. A biasing means engagement 52 (e.g. a notched extension from fulcrum end) extends rearwardly from fulcrum end 50 and is adapted to engage with a biasing means 54, such as a spring. Top 56 of second electrode 14 preferably has rounded edge so that fulcrum end 50 can rock thereon. Biasing means 54 tends to exert a downwardly pulling force on notched end extension end 52 and thereby tends to raise front end 48 of armature 46 upwardly. Armature 46 passes through a plunger window 58 in plunger slide member 28. Plunger slide member 28 is attached at its bottom end to a plunger plate 60, which is made of magnetic material (such as stainless steel), and which is preferably flat. C-clamp has an upper portion 26A which is located below plunger plate 60, and a lower portion 26B. First electrode 12 has a bent over upper end 62, which is located below front end 48 of armature 46. Apertures 64 are formed near bottom ends of first and second electrodes 12 and 14. Apertures 64 are useful for engaging electrodes 12 and 14 to a circuit or device with which electrical conductor relay 10 will be used (not shown.)

Figure 3:
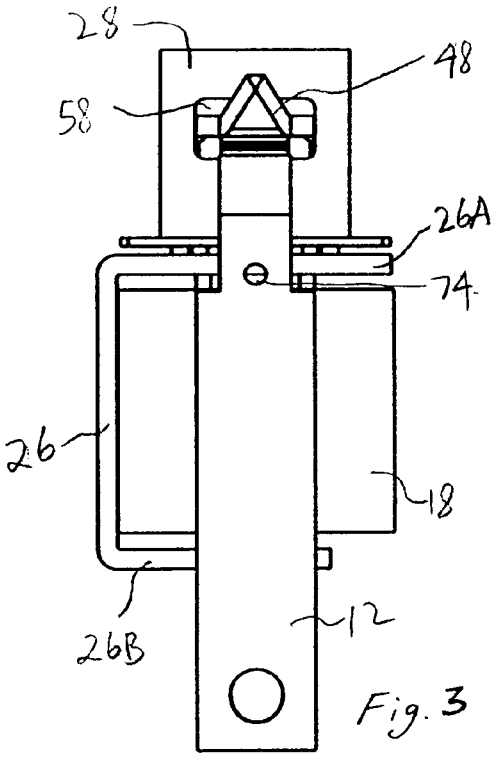
FIG. 3 is a exploded view of FIG. 1, with one modular relay separated from two other modular relay units.
Figure 4:
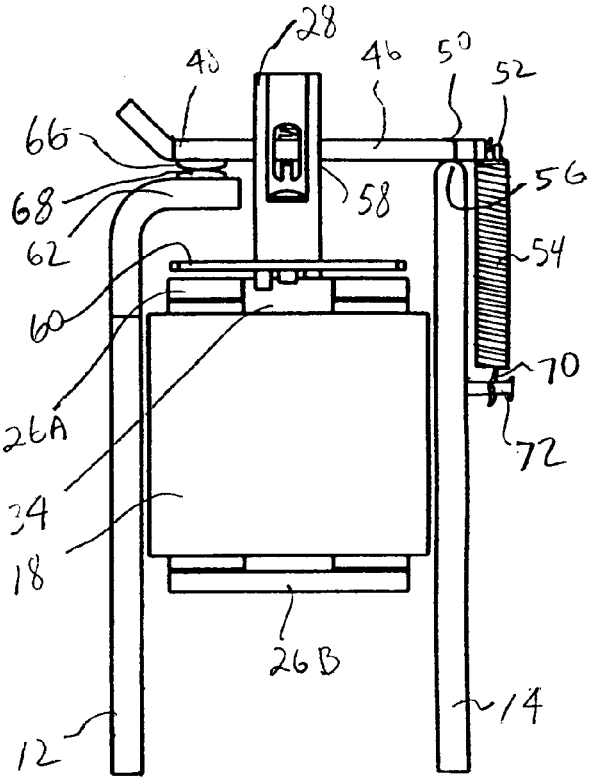
FIG. 4 is a top view of a single modular electrical relay conductor.

Referring to FIGS. 3 and 4, an armature contact 66 is located on underside of front end 48 of armature 46, and is preferably formed of highly conductive material, such as silver. Other highly conductive materials can be used as well. A first electrode contact 68 is located on upper surface of bent over end 62 of first electrode 12. First electrode contact 68 is also formed of highly conducting material, such as silver, and can be soldered or otherwise attached to first electrode. First electrode 12, second electrode 14, and armature 46 are preferably formed of solid electrically conducting material such as solid copper, bronze, and the like, and for enhanced electrical conductance, can be plated with higher conductance material, such as silver. Electrodes 12 and 14 need not be insulated. A bottom end 70 of spring 54 is attached to an engagement post 72 affixed to second electrode 14. First electrode 12 is affixed to upper portion 22 of chassis with a screw 74. Upper portion 26A of C-clamp 26 is spaced below plunger plate 60. C-clamp 26 preferably frictionally engages upper portion 22 and base portion 24.

Referring now to FIGS. 5–12, various features of combination chassis/bobbin 16 are shown and described.

Figure 6:
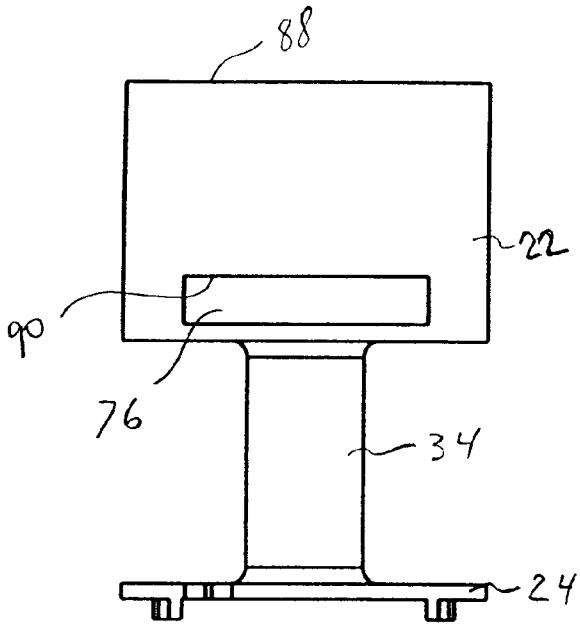
FIG. 6 is a side view of the combination chassis/bobbin assembly of FIG. 5.

FIG. 6 is a side view of combination chassis/bobbin assembly 16. C-clamp window 76 passes through upper portion 22 of chassis, and has a width that is preferably sized to slidably yet tightly receive upper portion 26A of C-clamp 26. C-clamp window 76 has an upper wall 90.

Figure 7:
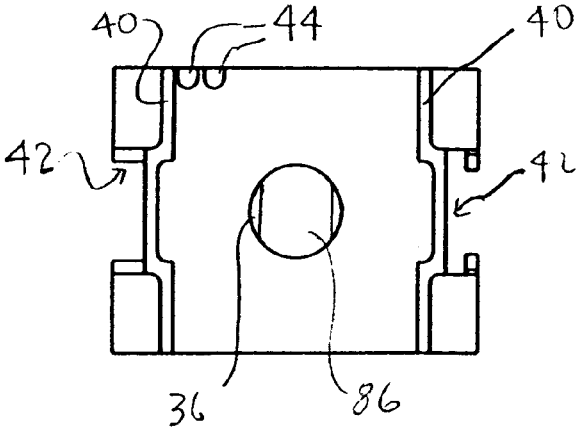
FIG. 7 is a bottom view of the combination chassis/bobbin assembly of FIG. 5.

FIG. 7 is a bottom view of combination chassis/bobbin assembly 16, and primarily shows the bottom of base portion 24, including C-clamp guides 40, electrode notches 42, and lead wire notches 44. A portion of a plunger slide passage 86 which is formed in upper portion 22 is partially seen thorough central core passage 36.

Figure 8:
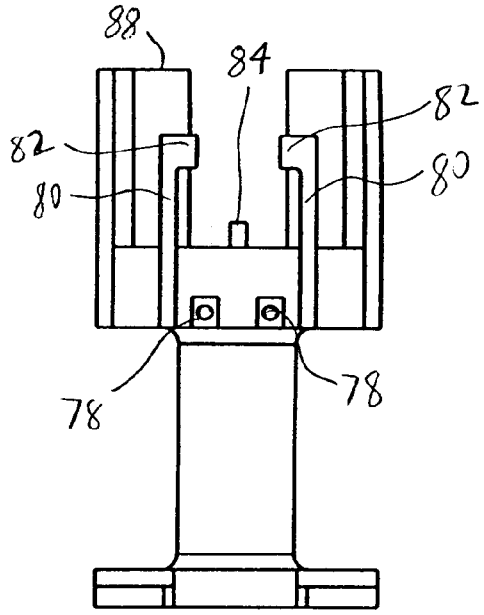
FIG. 8 is a rear view of the combination chassis/bobbin assembly of FIG. 5.

FIG. 8 is a rear view of the combination chassis/bobbin assembly 16. Screw holes 78 are formed in upper portion 22 and are for retaining second electrode 14 (not shown.) A pair of spaced apart armature guide walls 80 are shown, and are adapted to hold in place an upper portion of second electrode 14 and pivotally retain armature 46. Upper turned in ends 82 are provided to prevent fulcrum end 50 of armature 46 from sliding out between the pair of armature guide walls 80. A first electrode support 84 is provided to support bent over end 62 of first electrode 12.

Figure 9:
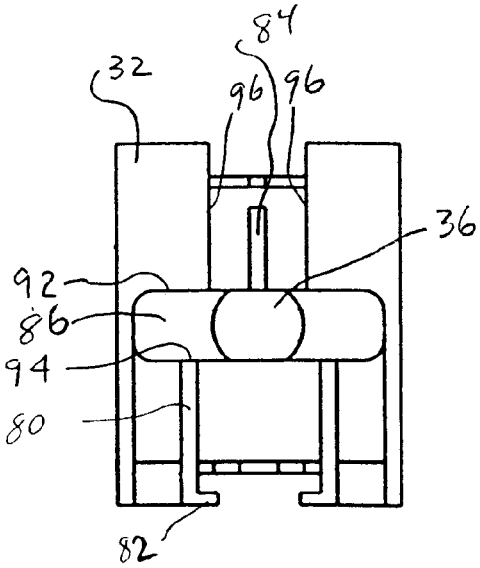
FIG. 9 is a top view of the combination chassis/bobbin assembly of FIG. 5.

FIG. 9 is a top view of the combination chassis/bobbin assembly 16. The pair of armature guide walls 80 with their upper turned in ends 82, and first electrode support 84, are shown. Also shown is plunger slide passage 86, which passes from a top 88 of upper portion 22 (see FIGS. 6 and 8) and extends down through upper wall 90 of C-clamp window 76. Rear walls 92 of permanent magnet cavities 30, and inwardly facing ends 94 of armature guide walls 80 further define the upper portion of plunger slide passage 84. The inside facing walls 96 of permanent magnet cavities 30 are spaced apart to receive front end 48 of armature 46, and armature guide walls are spaced apart to loosely receives the fulcrum end of armature 46. FIG. 5 further shows plunger slide passage 86, which intersects C-clamp window 76. A bottom end of plunger slide member 28 passes through plunger slide passage 86. A portion of central core passage 36 is shown below plunger slide passage 86.

Figure 10:
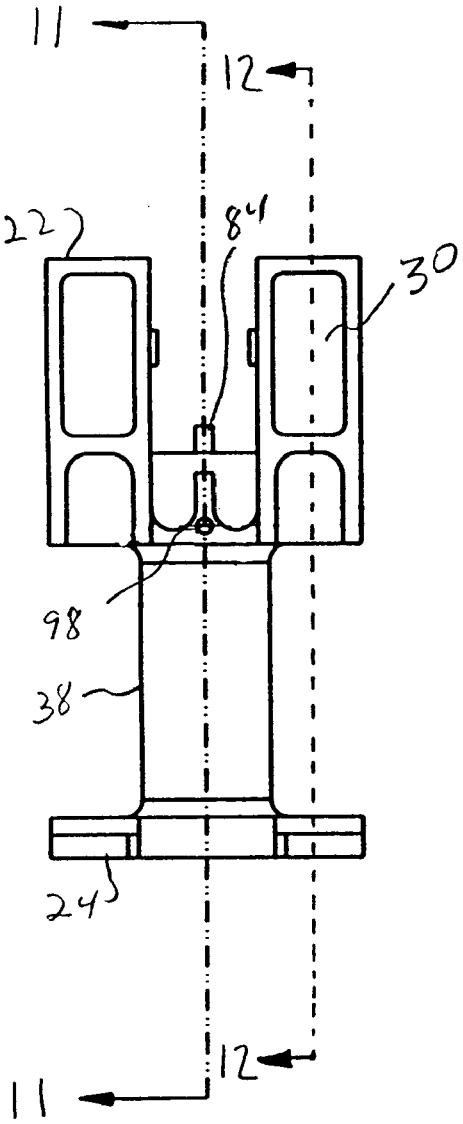
FIG. 10 is a front view of the combination chassis/bobbin assembly of FIG. 5.
Figure 11:
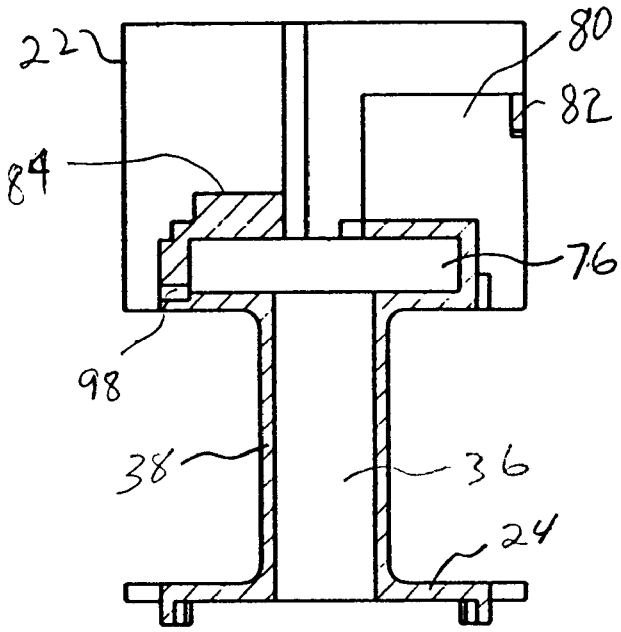
FIG. 11 is a cross-sectional view through view lines 11—11 of FIG. 10.
Figure 12:
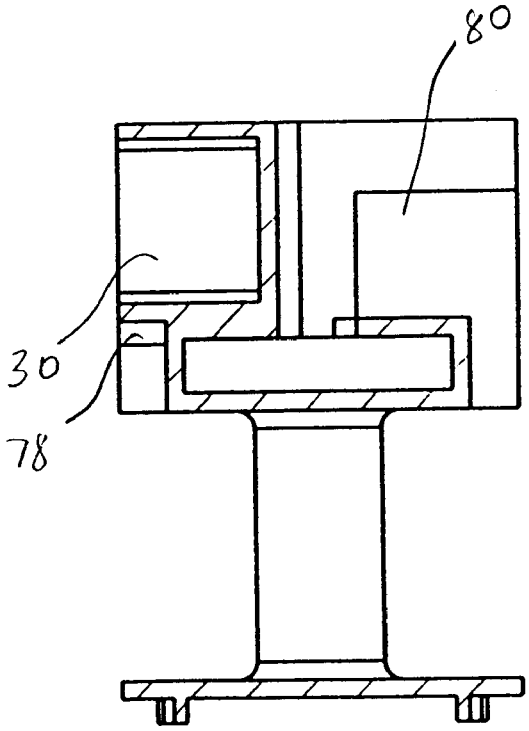
FIG. 12 is a cross-sectional view through view lines 12—12 of FIG. 10.

Referring to FIGS. 10–12, additional view of the combination chassis/bobbin assembly 16 are shown.

FIG. 10 is a front view of the combination chassis/bobbin assembly 16. A screw hole 98 for screw 74 is shown, as well as permanent magnet cavities 30 in upper portion 22, bobbin portion 38, base portion 24, and first electrode support 84.

FIG. 11 is a cross-sectional view through view lines 11—11 of FIG. 10, and shows in more detail central core passage 36 through bobbin portion 38, upper portion 22, base portion 24, C-clamp window 76, insides of armature guide wall 80, upper turned in end 82, first electrode support 84, and screw hole 98.

FIG. 12 is a cross-sectional view through view lines 12—12 of FIG. 10, and shows permanent magnet cavities 30, C-clamp window 76, screw holes 78, and the outside of armature guide wall 80.

Figure 13:
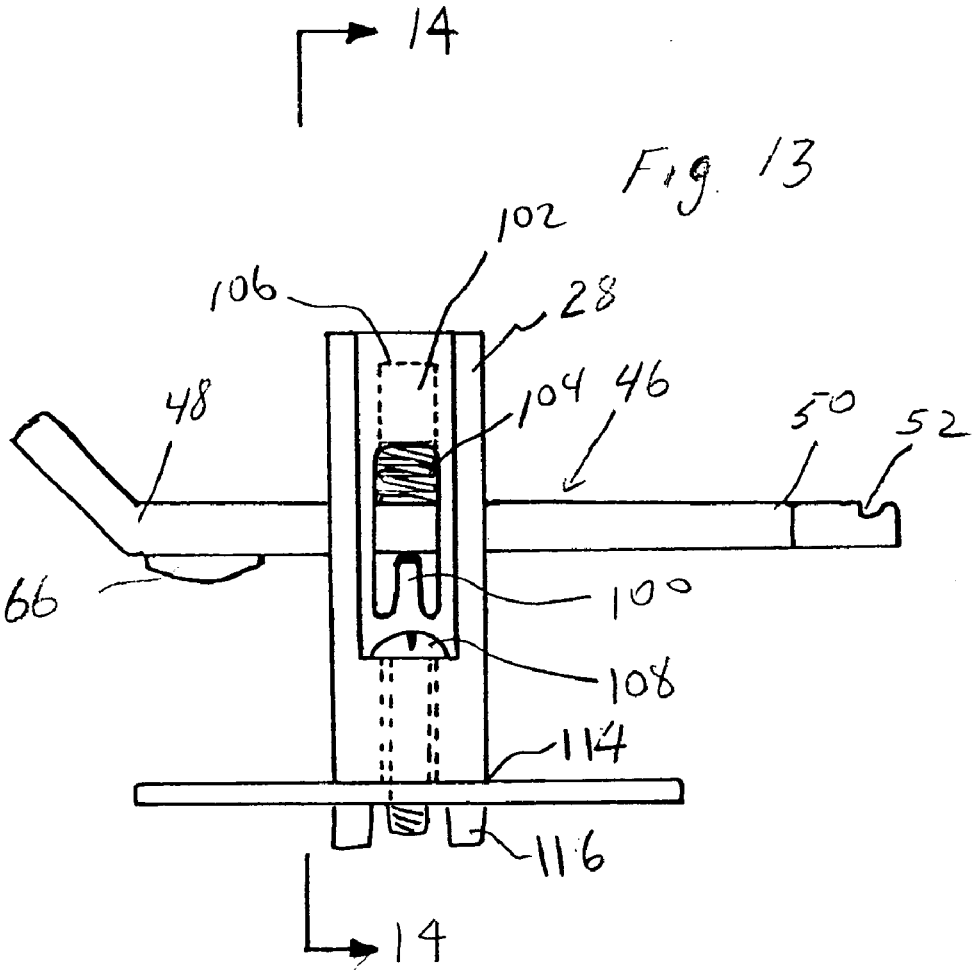
FIG. 13 is a side view showing the plunger assembly and armature.
Figure 14:
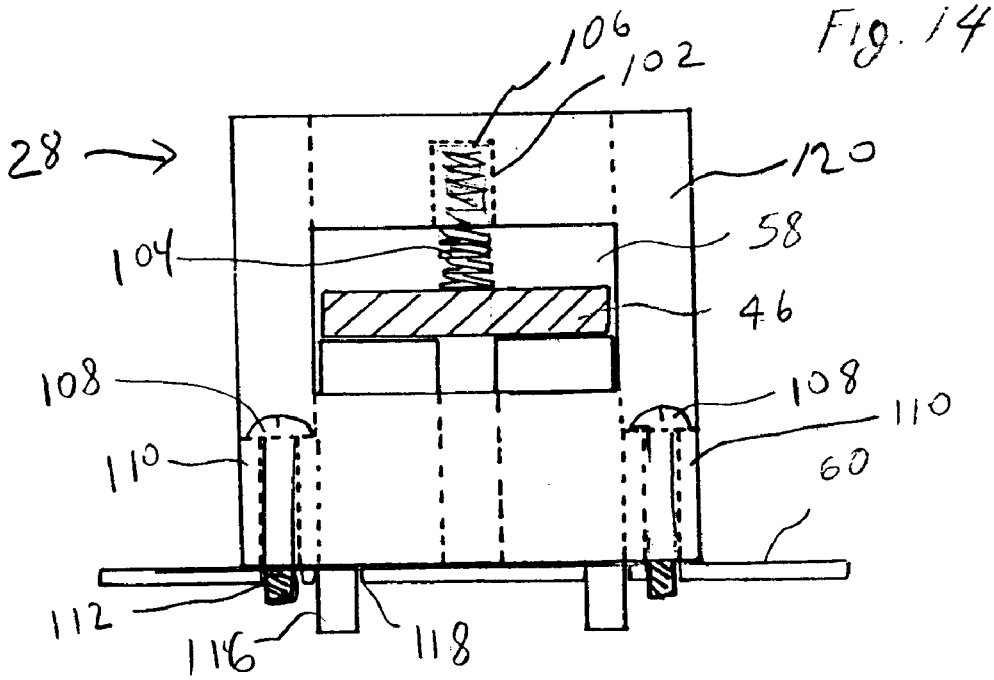
FIG. 14 is a cross-sectional view of the plunger assembly and armature along lines 13—13 of FIG. 13.

Turning next to FIGS. 13 and 14, views of plunger slide member 28, armature 46 and plunger plate 60 (forming a plunger assembly) are shown. Plunger slide member 28 has an armature fulcrum 100 extending upwardly into plunger window 58. A recess 102 is formed in an upper portion of plunger slide member 28 for receipt of a spring 104. Upper end of spring 104 is stopped at upper end 106 of recess 102, and lower end of spring 104 bears down on portion of armature 46 passing through plunger window 58 to assist in retaining armature 46 in position, yet permits armature 46 to rock on armature pivot 100. Plunger plate screws 108 pass through sides 110 of plunger slide member 28 and screw into screw holes 112 in plunger plate 60 to secure plunger plate 60 to bottom 114 of plunger slide member 28. Alignment protrusions 116 extending from bottom 114 of plunger slide member 28 pass through apertures 118 in plunger plate 60. Access recesses 120 provide for access to screws 108 and permit ease of assembly. Indeed, in the preferred embodiment, a total of five screws are used to retain together the parts. In its most basic form, plunger slide member 28 provides an armature moving means for translating up and down movement of plunger plate (in response to the state of electromagnetic coil 18) to armature 46, to thereby raise and lower armature contract away from first electrode contact, and alternate forms of plunger slide members 28 could be provided.

Figure 15:
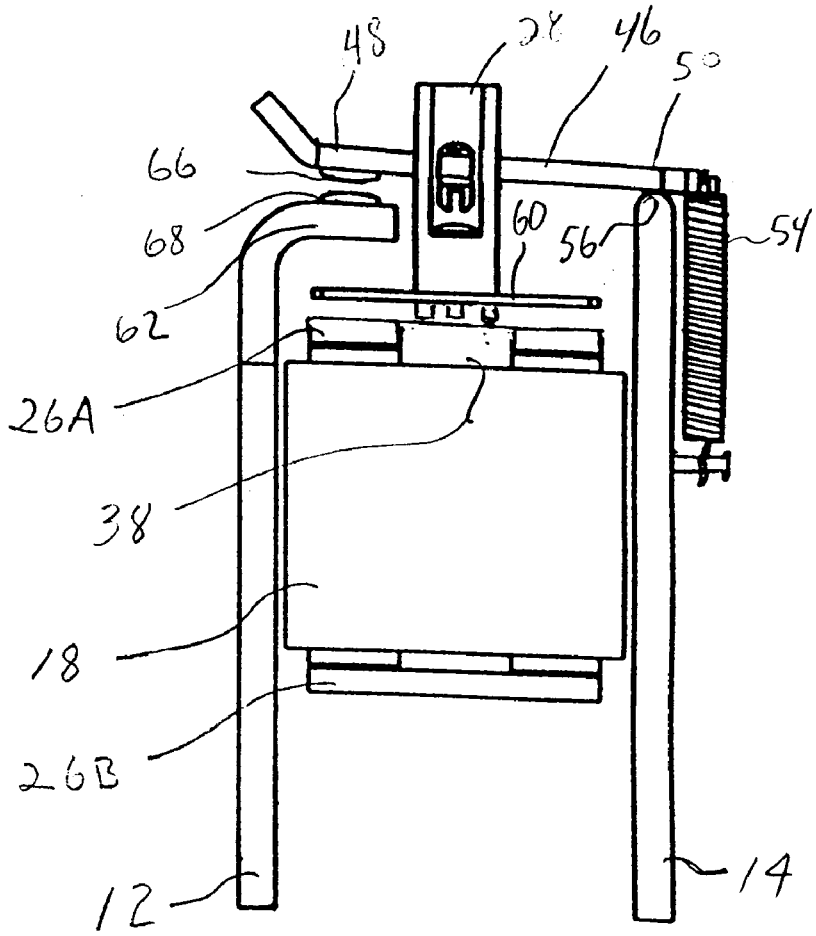
FIG. 15 is a side view of the electrical relay conductor with most of chassis portion removed, with the relay in the opened position.

Turning to FIG. 15, a side view of the electrical relay conductor 10, with most of chassis portion removed, is shown with the relay in the opened position, with the front end 48 of armature 46 raised upwardly so that armature contact 66 is separated from first electrode contact 68.

Figure 16:
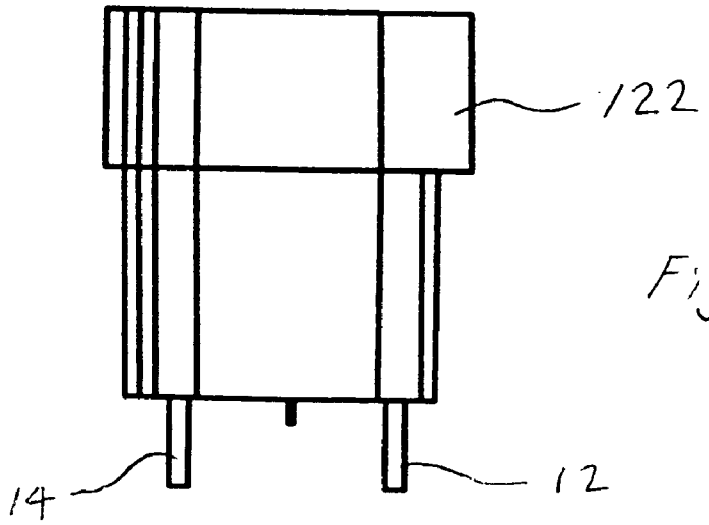
FIG. 16 is a front view showing the electrical relay conductor of the invention placed in its enclosure.

FIG. 16 is a front view showing the electrical relay conductor of the invention placed in its enclosure housing 122, with first and second electrodes 12 and 14 extending therefrom.

Having described the various components and features of the electrical conductor relay 10 of the invention, a description of its operation is now made. Referring back to FIGS. 2 and 4, when electrical current is applied to electromagnetic coil 18, a magnetic force is generated in magnetic metal core 34 which attracts plunger plate 60 downwardly in the direction of top of C-clamp 26A, which thereby also pulls plunger slide member 28 downwardly. This magnetic force exceeds the counteracting force of spring 54. The result is that armature contact 66 on armature 46 is brought into electrical contact with first electrode contact 68. Since fulcrum end 50 of armature 46 is always in electrical contact with top end 56 of second electrode 14, the circuit between electrodes 12 and 14 is now closed, and continuity of the circuit is established between first and second electrode 12 and 14, respectively.

Turning back to FIG. 15, when no electrical current is applied to electromagnetic coil 18, there is no magnetic force to attract plunger plate 60 downwardly into direction of magnetic metal core 34 in opposition to the biasing force of spring 54, and therefore, armature contact 66 is moved apart from first electrode contact 68. As an additional failsafe measure, permanent magnets 32 in permanent magnet cavities 30 will tend to attract plunger plate 60 upwardly, and thereby prevent front end 48 of armature 46 and armature contact 66 from dropping down, except when magnetic coil 18 is energized.

The above noted design provides for simplicity of design, uses relatively few parts, reduces the amount of expensive, precious materials required (because it only requires to contacts), increases reliability, and decreases assembly time.

What is claimed is:

1. A electrical conductor relay, comprising:

a non-conducting, combination chassis/bobbin assembly including a base portion, a bobbin portion, and an upper portion, the upper portion having a window and a plunger slide passage formed therethrough, the plunger slide passage communicating with the window, the base portion and the bobbin portion having a central core passage formed therethrough which extends into the window of the upper portion;

an electromagnetic coil located around the bobbin portion and a magnetic metal core located in the central core passage, with a portion of magnetic metal core extending up into the window of the upper portion;

a first electrode and a second electrode attached to the combination chassis/bobbin assembly, the first electrode having a first electrode contact, the second electrode having a top end;

a plunger slide member that is adapted to move within the plunger slide passage and having a magnetic metal plunger plate affixed to a bottom thereof, the magnetic metal plunger plate being movably located in the window in the upper portion and spaced above the portion of magnetic metal core extending up into the window;

a conducting armature with a fulcrum end with a biasing means engagement extending rearwardly therefrom, and a front end with an armature contact on an underside surface thereof, the armature being pivotally engaged with the plunger slide member, the fulcrum end pivotally contacting the top end of the second electrode with the biasing means engagement extends rearwardly therefrom; and a biasing means that engages the biasing means engagement which tends to raise the front end of the armature, thereby raising the armature contact away from the first electrode contact when the electromagnetic coil is not energized.

2. The electrical conductor relay of claim 1, further comprising a magnetic metal C-clamp engaged the with base portion and the upper portion of the combination chassis/bobbin assembly.

3. The electrical conductor relay of claim 1, wherein the combination chassis/bobbin assembly is a unitary structure formed from a single piece of plastic material.

4. The electrical conductor relay of claim 1, wherein the first and second electrodes are formed solely of metal.

5. The electrical conductor relay of claim 1, wherein the armature contact and the first electrode contact are formed of a higher conductance metal than the metal of the first and second electrodes.

6. The electrical conductor relay of claim 5, wherein the higher conductance metal is silver.

7. The electrical conductor relay of claim 1, wherein the biasing means is a spring and the biasing means engagement comprises a notched extension portion that extends rearwardly of the fulcrum end of the armature.

8. The electrical conductor relay of claim 2, wherein an upper portion of magnetic metal C-clamp slides into the window and a lower portion of magnetic metal C-clamp slidably engages with a bottom surface of the base portion, the C-clamp being frictionally engaged with the combination chassis/bobbin assembly.

9. The electrical conductor relay of claim 1, wherein the plunger slide member has a plunger window, an armature fulcrum at a bottom of the plunger window, and a spring that impinges upon a portion of armature that passes thorough the plunger window, wherein the plunger slide member is adapted to slidably pass through the plunger slide passage, and the magnetic metal plunger plate is movably located in the window in the upper portion and is spaced above the portion of magnetic metal core extending up into window.

10. The electrical conductor relay of claim 1, further comprising a permanent magnet in the upper portion above which the permanent magnet tends to exert magnetic attraction force on the magnetic metal plunger plate.

11. The electrical conductor relay of claim 1, wherein the upper portion further comprises spaced apart armature guide walls for guiding movement of the armature.

12. The electrical conductor relay of claim 1, wherein an upper end of first electrode in the vicinity of the first electrode contact is bent over.

13. A electrical conductor relay, comprising:

a non-conducting, combination chassis/bobbin assembly including a base portion, a bobbin portion, and an upper portion, the upper portion having a window formed therethrough, the base portion and the bobbin portion having a central core passage formed therethrough which extends into the window of the upper portion;

an electromagnetic coil located around the bobbin portion and a magnetic metal core located in the central core passage, with a portion of magnetic metal core extending up into the window of the upper portion;

a first electrode and a second electrode attached to the combination chassis/bobbin assembly, the first electrode having a first electrode contact, the second electrode having a top end;

a conducting armature with a fulcrum end with a biasing means engagement extending rearwardly therefrom, and a front end with an armature contact on an underside surface thereof, the fulcrum end pivotally contacting the top end of the second electrode with the biasing means engagement extends rearwardly therefrom;

an armature moving means including a magnetic metal plunger plate located in the window and spaced above a portion of magnetic metal core extending up into the window and a means for engaging with the armature so that up and down movements of the magnetic metal plunger plate will move the front end of armature; and a biasing means that engages the biasing means engagement which tends to raise the front end of the armature, thereby raising the armature contact away from the first electrode contact when the electromagnetic coil is not energized.

14. The electrical conductor relay of claim 13, further comprising a magnetic metal C-clamp engaged with the base portion and with the window of the upper portion of the combination chassis/bobbin assembly.

15. The electrical conductor relay of claim 13, wherein the combination chassis/bobbin assembly is a unitary structure formed from a single piece of plastic material.

16. The electrical conductor relay of claim 13, wherein the first and second electrodes are formed solely of metal and the armature contact and the first electrode contact are formed of a higher conductance metal than the metal of the first and second electrodes.

17. The electrical conductor relay of claim 13, wherein the biasing means is a spring and the biasing means engagement comprises a notched extension portion that extends rearwardly of the fulcrum end of the armature.

18. The electrical conductor relay of claim 13, further comprising a permanent magnet in upper portion, which permanent magnet tends to exert magnetic attraction force on the magnetic metal plunger plate.

* * * * *